United States Patent [19]

Kirkpatrick

[11] 4,428,578

[45] Jan. 31, 1984

[54] EXERCISING DEVICE

[76] Inventor: Thomas L. Kirkpatrick, 3509 Quincy Ave., Simi Valley, Calif. 93063

[21] Appl. No.: 273,582

[22] Filed: Jun. 15, 1981

[51] Int. Cl.[3] ..... A63B 21/04

[52] U.S. Cl. ..... 272/136; 272/143; 272/900

[58] Field of Search ..... 272/900, 136, 142, 143, 272/135, 80, 22

[56] References Cited

U.S. PATENT DOCUMENTS

| | | | |
|---|---|---|---|
| 1,969,165 | 8/1934 | Turner | 272/900 X |
| 4,026,548 | 5/1977 | Birdwell | 272/136 |
| 4,076,237 | 2/1978 | Dassia | 272/136 |
| 4,185,816 | 1/1980 | Bernstein | 272/900 X |

*Primary Examiner*—Richard J. Apley
*Assistant Examiner*—William R. Browne
*Attorney, Agent, or Firm*—Jack C. Munro

[57] ABSTRACT

An exercising device which is to connect with the bottom edge of a door with the door being located in the closed position with respect to the door jam. The exercising force is to be transmitted through the door against the door jam. The exercising device is attached to the door by means of an attaching bracket assembly which is removably secured to the door. Between the attaching bracket assembly and a handle assembly is located an elastic, elongated stretchable cord. The cord can be either solid in cross-section or can be tubular. Connected to the handle assembly is an adjustable strap which is to be located about portions of the user's body during the performing of certain exercises. The handle assembly includes a cushiony pad which is to abut portions of the user's body during the performing of certain exercises as to provide a soft cushiony surface. The elongated stretchable cord is almost entirely located between an enclosing tube.

6 Claims, 3 Drawing Figures

EXERCISING DEVICE

BACKGROUND OF THE INVENTION

The field of this invention relates to an exercising device and more particularly to a portable exercising device which is to be connectable to a door, thereby making the exercising device readily usable in any building structure.

The use of exercising devices have been long been known. Frequently, such exercising devices are complex in construction and are of a large physical size. Normally, such exercising devices are not readily portable, but are to be located in a particular location and are to remain in that location during usage.

It would be desirable to utilize an exercising structure which could be readily utilized within a building structure and did not require any permanent attachment to the building structure. It would also be desirable to design such an exercising device which could be readily utilized with many types of exercises. It would also be desirable to employ an exercising device which is non-complex in construction and which can be manufactured relatively inexpensively.

SUMMARY OF THE INVENTION

The exercising device of this invention is designed to be employed in conjunction with a structure, such as a door. A bracket assembly is removably secured to the bottom edge of the door. Once the bracket assembly is in position, the free end of an elongated, stretchable cord (such as surgical tubing) is removably secured through the attaching bracket assembly. The stretchable cord is contained within a rigid tube strictly as a safety precaution in case the cord breaks, so that it will not strike the user. The tube, as well as the inner end of the stretchable cord, is attached to an apex section of a handle assembly. A adjustable strap is attached to the handle assembly which permits usage of the exercising device other than with the person's hands. The apex section of the handle section has attached thereby a cushiony pad which is to function as a head rest during the performance of certain exercises so as to prevent direct contact with the user by the rigid handle section.

DETAILED DESCRIPTION OF THE SHOWN EMBODIMENT

Figures 1, 2, 3:
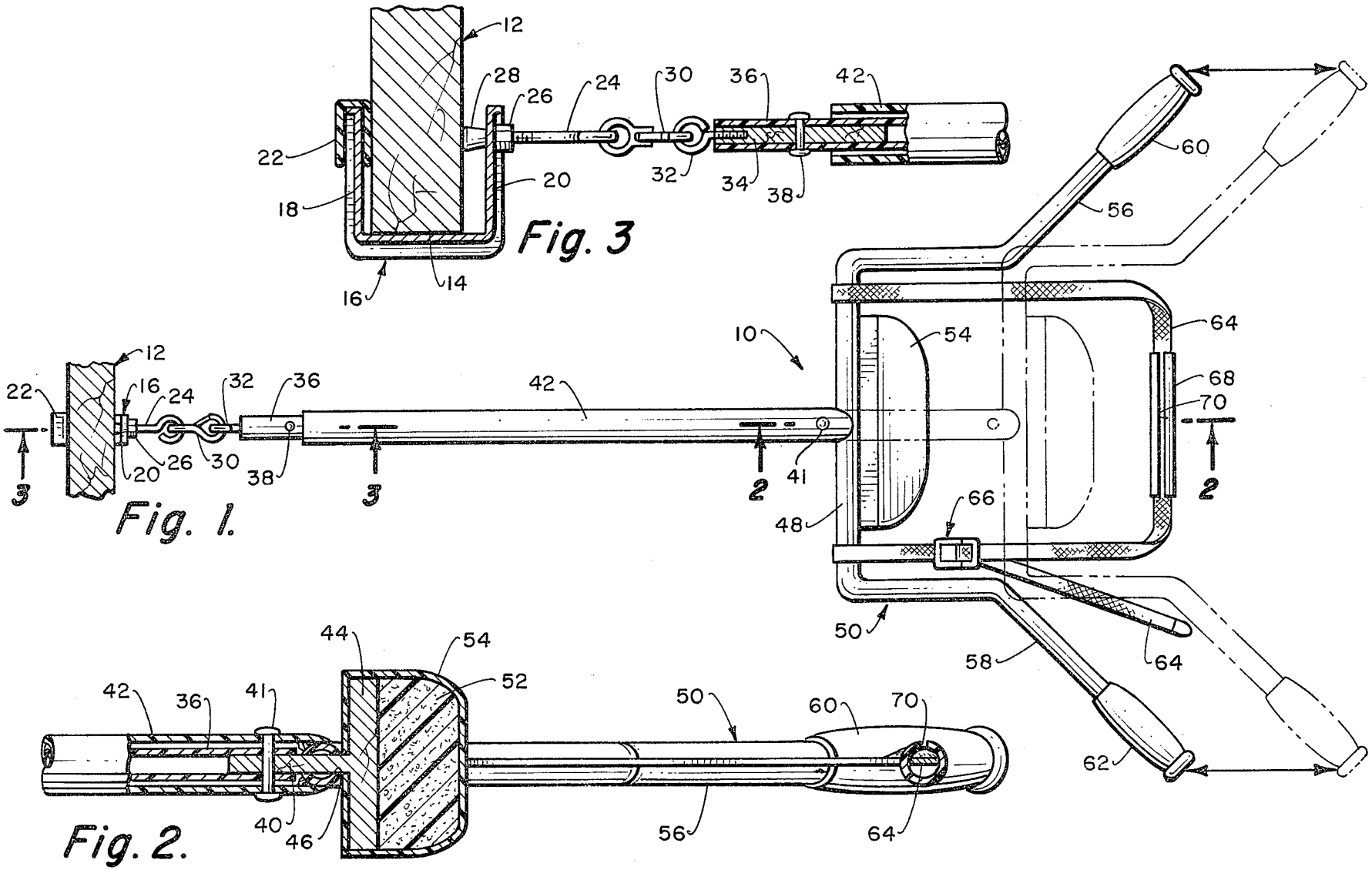
FIG. 1 is a top plan view of the exercising device of this invention showing the exercising device being attached to a conventional door.
FIG. 2 is a cross-sectional view through a portion of the exercising device of this invention taken along line 2—2 of FIG. 1.
FIG. 3 is a cross-sectional view through a portion of the exercising device of this invention taken along line 3—3 of FIG. 1.

Referring particularly to the drawing, there is shown the exercising device 10 of this invention which is to be connected to a conventional door 12. The door 12 will normally be about two inches in thickness and will include a bottom edge 14. An attaching bracket in the form of a U-shaped member 16 is to be located about the bottom edge 14 of the door so that spaced-apart parallel legs 18 and 20 of the U-shaped member 16 are located on opposite sides of the door 12. A protective pad 22 of either rubber or plastic is located about the edge of the leg 18. A conventional eyebolt threaded fastener 24 is threadably secured to a nut 26 which in turn is fixedly mounted onto the leg 20. The threaded fastener 24 extends through an appropriate hole formed within the leg 20 and terminates in a resilient foot 28. It can be seen that by tightening of the eyebolt fastener 24, the foot 28 is to snugly abut the outer surface of the door 12 with the resilient pad 22 abutting the inner surface of the door 12. In this manner, the attaching bracket assembly 16 is securely fixed onto the door 12.

Attached to the eyebolt fastener 24 is a hook snap fastener 30. The snap fastener 30 snaps on to eyebolt 32. The eyebolt 32 is securely mounted within a wood dowel 34. Located about the wood dowel 34 in a close fitting manner is the outer end of the stretchable cord 36. The outer end of the stretchable cord 36 is secured to the wood dowel 36 by means of rivet 38.

The stretchable cord 36 can take any of numerous forms, but a desirable type is what is frequently termed "surgical tubing". The inner end of the stretchable cord 36 is fixedly secured to a second wood block 40 by means of a rivet fastener 41.

Located about the stretchable cord 36 in a loose fitting manner is a tube 42. The tube 42 is substantially rigid in construction. The tube 42 is also fixedly mounted by rivet 41 to the plug 40. The length of the tube 42 is such that it is very nearly the length of the stretchable cord 36 when in the at-rest state. The purpose of the tube 42 is for safety. That is, if per chance, the stretchable cord 36 breaks, there would potentially occur a dangerous whipping action, which, if the cord strikes the user of the exercising device 10 of this invention, the user could be injured. Therefore, by encasing the stretchable cord 36 with the tube 42, this possibility is eliminated.

The wood block 40 is integrally connected to plate member 44. The wood plug 40 also extends through a hole 46 formed within an apex tubular member 48 of a handle assembly 50.

Attached to the enlarged planar outer surface of the plate member 44 is a quantity of resilient cushiony material (such as foam rubber) 52. Covering the cushiony material 52 and the plate member 44 is a leather or vinyl covering 54.

Integrally extending at substantially a right angle from one of the ends of the apex tubular member 48 is a first handle rod 56. A similar handle rod 58 is integrally connected to the opposite end of the apex tubular member 48 and also extends perpendicular therefrom. It is to be noted that the handle rod 58 is substantially a mirror image of the handle rod 56. The outer end of the handle rod 56 has mounted thereon a handle grip 60 with a similar handle grip 62 being attached to the outer end of the handle rod 58.

The free ends of a strap assembly 64 are connected to the apex tubular member 48 in a spaced-apart relationship. This strap assembly 64 includes a conventional buckle assembly 66 for purposes of longitudinal adjustment. The purpose of the strap assembly 64 will be explained further on in the specification.

The strap assembly 64 may optionally include the use of a graspable, rigid handle member 68. The handle member 68 includes a longitudinal slot 70. The purpose of the slot 70 is so to permit access of the strap 64 to within the handle member 68 and then the handle members 68 is pivoted ninety to one hundred and eighty degrees prior to usage.

The operation of the exercising device 10 of this invention is as follows: With the mounting bracket assembly tightly installed onto the door 12 and the door 12 located in a closed position against the door jam, the user may then perform various types of exercises. One type of exercise would be for the user to grasp the handle grips 60 and 62 and by sitting on the floor, pull the exercising device toward the user, thereby stretching the cord 36. An advantage of using the stretchable cord 36 is that initial stretching requires a lower amount of force with greater stretching requiring a greater amount of force. By using the stretchable cord, the user has inherently available various force settings. In other words, the user only needs to stretch the cord slightly to complete an exercise having a lower force requirement. If the user stretches the cord an initial amount and then completes a series of exercises, a higher force is required. In other words, the exercising device of this invention could be readily utilized by both the physically strong as well as the physically weak.

Another exercise that can be employed is with the user laying on his or her back, grabbing the handle grips 60 and 62, the user can pull the exercising device until the cushion 52 comes into contact with the person's head. One way in which the straps 64 can be utilized is for one or both of the user's legs to be located within the enclosed area of the strap 64 adjacent the cushion 52. The user can then move his leg or legs against the strap 64 in order to effect stretching of the cord 36.

The user also has the option of inserting the handle 68 onto the strap 64. The user can then do an exercise with either one or two hands being applied to the handle 68 in order to effect stretching of the cord 36.

It is to be understood that the buckle assembly 66 is to adjust to accommodate different physical sizes of users.

What is claimed is:

1. In combination, an exercising device to attachable to a door comprising:

an attaching bracket assembly for removably securing said exercising device to a door;

a connecting means for connecting the exercise device to said bracket assembly;

an elongated stretchable cord having an outer end and a inner end, said outer end attached to said connecting means, said connecting means being removably connected to said attaching bracket assembly;

a graspable handle assembly attached to said inner end of said elongated stretchable cord, manual movement of said handle assembly is capable of causing stretching of said stretchable cord;

said stretchable cord being mounted within an enclosing tube that extends substantially from said inner end to said outer end, with said stretchable tube in its at-rest position the said enclosing tube substantially totally encasing said stretchable cord, the portion of said enclosing tube located at said inner end being attached to said graspable handle assembly with another portion of said enclosing tube located near said outer end being free;

said graspable handle assembly including a rigid elongated apex section from which extends substantially perpendicular a pair of spaced-apart handle rods, said enclosing tube being connected to said apex section; and said apex section including a cushiony pad, said cushiony pad being in contact with portions of the body of the user during an exercise program.

2. The combination as defined in claim 1 wherein:

said attaching bracket assembly is connected to a bottom edge of a door.

3. The combination as defined in claim 2 wherein:

said attaching bracket assembly including a substantially U-shaped member having a pair of spaced-apart legs, a threaded member connected with one of a legs, said threaded member to be movable to bind said door between the other of said legs and said threaded member thereby securing a attaching bracket to said door.

4. The combination as defined in claim 3 wherein:

said connecting means comprising a snap fastener.

5. The combination as defined in claim 1 wherein:

a strap assembly being secured to said graspable handle assembly, said strap assembly to be utilized in conjunction with said graspable handle assembly to facilitate the performing of certain exercices.

6. The combination as defined in claim 5 wherein:

said strap being adjustable.

* * * * *